US005733091A

United States Patent [19]

Long

[11] Patent Number: 5,733,091

[45] Date of Patent: Mar. 31, 1998

[54] RAIL TRANSPORTABLE RAMPS FOR CIRCUS LOADING STANDARD HIGHWAY SEMI-TRAILERS

[75] Inventor: James Long, Ripley, N.Y.

[73] Assignee: General Electric Company, Erie, Pa.

[21] Appl. No.: 848,557

[22] Filed: Apr. 28, 1997

Related U.S. Application Data

[63] Continuation of Ser. No. 701,912, Jul. 29, 1996, abandoned, which is a continuation of Ser. No. 369,224, Jan. 6, 1995, abandoned.

[51] Int. Cl.[6] ..... B60P 3/06

[52] U.S. Cl. ..... 414/333; 414/537

[58] Field of Search ..... 414/537, 538, 414/333, 786; 14/69.5, 71.5

[56] References Cited

U.S. PATENT DOCUMENTS

| | | | |
|---|---|---|---|
| 735,005 | 7/1903 | Ware | 14/71.1 X |
| 1,933,811 | 11/1933 | Kossakowski | 414/537 X |
| 3,063,386 | 11/1962 | Price | 14/71.1 X |
| 3,147,869 | 9/1964 | Fujioka et al. | 414/537 X |
| 3,153,489 | 10/1964 | Leavengood et al. | 414/537 |
| 3,704,794 | 12/1972 | Flamm | 414/537 |
| 3,711,882 | 1/1973 | Iller | 414/537 X |
| 3,854,423 | 12/1974 | Bridge | 105/368 |
| 4,078,678 | 3/1978 | Tordella | 414/537 |
| 4,179,997 | 12/1979 | Kirwan | 414/333 X |
| 4,230,431 | 10/1980 | Stoller et al. | 410/59 |
| 5,017,065 | 5/1991 | Krug et al. | 410/58 |
| 5,066,188 | 11/1991 | Bush | 414/537 X |

FOREIGN PATENT DOCUMENTS

| | | | |
|---|---|---|---|
| 563145 | 7/1924 | France | 414/538 |
| 1173693 | 2/1959 | France . | |
| 2536716 | 6/1984 | France . | |
| 2518928 | 11/1976 | Germany . | |

*Primary Examiner*—David A. Bucci
*Attorney, Agent, or Firm*—Marvin Snyder; Douglas E. Stoner

[57] ABSTRACT

A rail transportable ramp assembly for intermodal trains comprises a pair of parallel, spaced ramp members each having a first end for engaging a ground level surface and a second end for engagement with a loading end of a rail car. A rigid cross-member extends between the ramp members adjacent the first ends. A flange is attached to the second ends of the ramp members for releasably coupling the ramp members to the rail car. The rail car has a slanted surface on each of opposite sides of the loading end for engaging the flange and restraining the ramp members. The rail car also incorporates rollers at the loading end for facilitating movement of the ramp members between a loaded position and a latching position.

2 Claims, 4 Drawing Sheets

RAIL TRANSPORTABLE RAMPS FOR CIRCUS LOADING STANDARD HIGHWAY SEMI-TRAILERS

This application is a continuation of application Ser. No. 08/701,912, filed Jul. 29, 1996, now abandoned, which application is a continuation of application Ser. No. 08/369,224, filed Jan. 6, 1995, now abandoned.

BACKGROUND OF THE INVENTION

The present invention relates to rail car loading systems and, more particularly, to a rail car transportable ramp for loading semi-trailers onto flat rail cars.

It has become common practice to transport semi-trailers over long distances by loading the trailers onto flat bed rail cars. Rail cars suitable for such use have been developed and are generally known as articulated flat cars while a train of such cars is sometimes referred to as an intermodal train. Articulated flat cars differ from conventional rail cars in not being as heavily constructed since the semi-trailer loads are relatively light, in having different forms of connectors between cars, and in being constructed at each end so as to form a continuous pathway from car-to-car for circus style loading of semi-trailers. In circus style loading, semi-trailers are attached to a yard tractor or hostler and backed onto a first rail car and then along a series of articulated cars until reaching a position for mounting. The trailers are mounted to the rail car by locking the wheels in place and attaching the front of the trailer to a stanchion attached to the bed of the rail car.

One difficulty with loading semi-trailers on intermodal trains stems from the need to raise the semi-trailer onto the elevated rail car. In some instances, this difficulty is avoided by loading each semi-trailer using a crane, i.e., by lifting each trailer into position. In other systems, one rail car is positioned adjacent a concrete platform having ramps allowing the semi-trailers to be driven onto the platform from whence they can then be manipulated onto the rail car. This latter technique restricts loading and unloading to special locations.

Another attempt to overcome the above difficulty is disclosed in U.S. Pat. No. 5,222,443. This patent describes a special ramp car which comprises two overlapping ramps, each mounted to a respective set of wheels. In a lowered position, each ramp is attached to an adjacent rail car at its respective wheeled end so that two ramps exist for driving trailers onto two sections of an intermodal train. When loading is completed, the two ramps are returned to their overlapping position to form a rail car assembly having a set of wheels on each end. This particular apparatus is complicated, requiring control and power devices for separating and assembling the ramps.

SUMMARY OF THE INVENTION

It is an object of the present invention to provide a rail car transportable ramp suitable for use in circus style loading of semi-trailers on rail cars.

In accordance with a preferred embodiment, the present invention comprises a ramp which can be stored on the bed of a flat bed rail car during transit and can be easily positioned and locked to an end of a rail car for loading/unloading of trailers. The ramp comprises a pair of spaced runways joined together at one end. The one end is designed to rest substantially flush on a ground surface when a second end of the ramp is locked into loading position on a rail car. The trailers can then be driven onto the ramp between the rail car and ground for loading and unloading. One form of attachment of the second end of the ramp to the rail car is by modifying the rail car to include a V-shaped recess at one end incorporating a roller at the intersection of the recess and rail car surface. A flange on the ramp seats in the recess when the ramp is in a loading position. The roller facilitates loading/unloading of the ramp onto the rail car bed.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENTS

Figure 1:
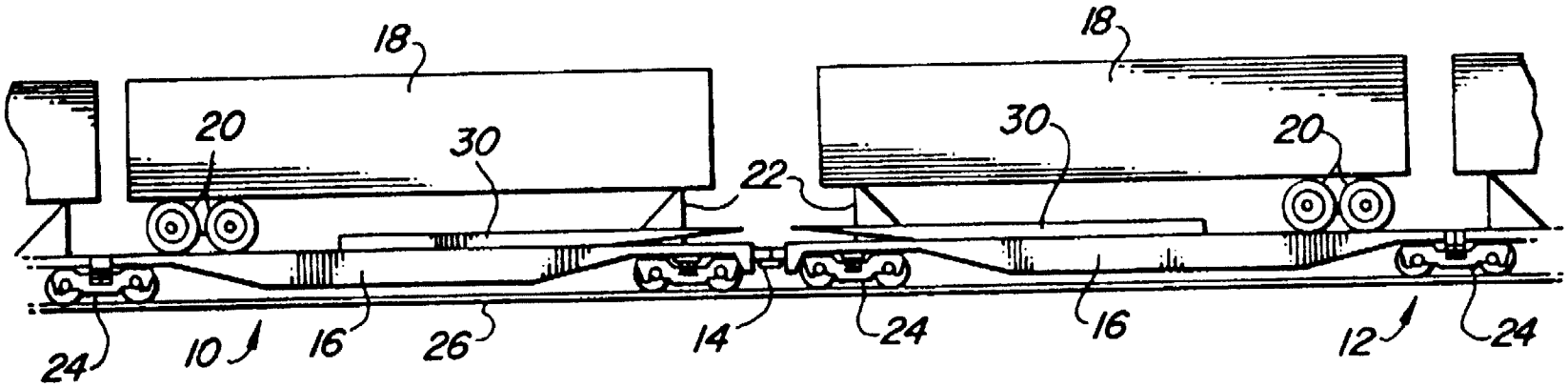
FIG. 1 is an elevation view of a section of an intermodal train, showing transport of loading ramps according to one aspect of the present invention.

FIG. 1 shows a section of an intermodal train including a first group of articulated flat cars 10 and a second group of articulated flat cars 12 coupled together by means of a conventional rail car coupler 14. Each of the articulated flat car groups 10 and 12 comprises individual articulated flat cars 16 of a type used conventionally in intermodal train systems. Typically, the cars are 50–60 feet in length and designed to hold a single large semi-trailer 18 or two shorter semi-trailers. Each trailer 18 is supported at its rear end by a conventional wheel and axle set 20 and at the front end by a stanchion 22 which attaches to a kingpin (not shown) on the front end of the trailer. Each end of rail cars 16 is attached to a conventional truck or wheel axle set 24 which rides on rails 26. As previously discussed, a difficulty in carrying semi-trailers 18 on rail cars 16 steps from the need for lifting the semi-trailers onto the elevated flat beds of cars 16. In the invention, semi-trailers 18 are positioned on the rail cars by being driven onto the cars via ramps 30 which are carried on the flat beds of rail cars 16 beneath the front end portions of semi-trailers 18.

Figure 2:
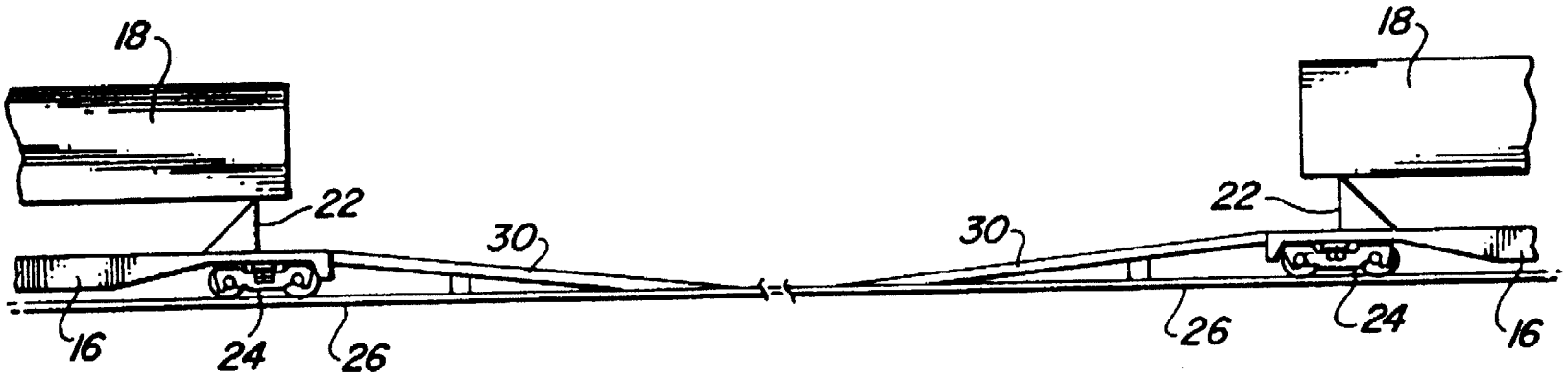
FIG. 2 illustrates separation of the ramp-carrying rail cars of FIG. 1, with the ramps in a loading/unloading position.

FIG. 2 shows a simplified representation of the train of FIG. 1 in which coupler 14 has been disconnected to allow rail cars 16 to be spaced apart and each ramp 30 to be moved from beneath a semi-trailer 18 to a position connected to a loading end of a respective rail car 16 with a distal end of the ramp resting on a ground surface. In this position, a yard tractor, or hostler of a type conventionally used to move semi-trailers, can be connected to trailers 18 so that the trailers can be removed from rail cars 16 by merely driving the yard tractor with each semi-trailer attached, one-by-one, down a respective one of ramps 30. As is well known, the articulated car section of an intermodal train consists of a group of such cars so that the semi-trailers can be loaded onto and unloaded from the rail cars in circus style. More particularly, onloading begins by driving a first semi-trailer up onto ramp 30 and along several of the interconnected articulated cars to the end of a section. The semi-trailer is then disconnected from the yard tractor and mounted on a stanchion 22. The yard tractor then returns and picks up another trailer, backing it down the length of several articulated cars 16 until it is positioned adjacent the previously positioned semi-trailer. In this manner, the semi-trailers are sequentially loaded by driving the tractor with a trailer down the length of several of articulated cars 16.

Figure 3A:
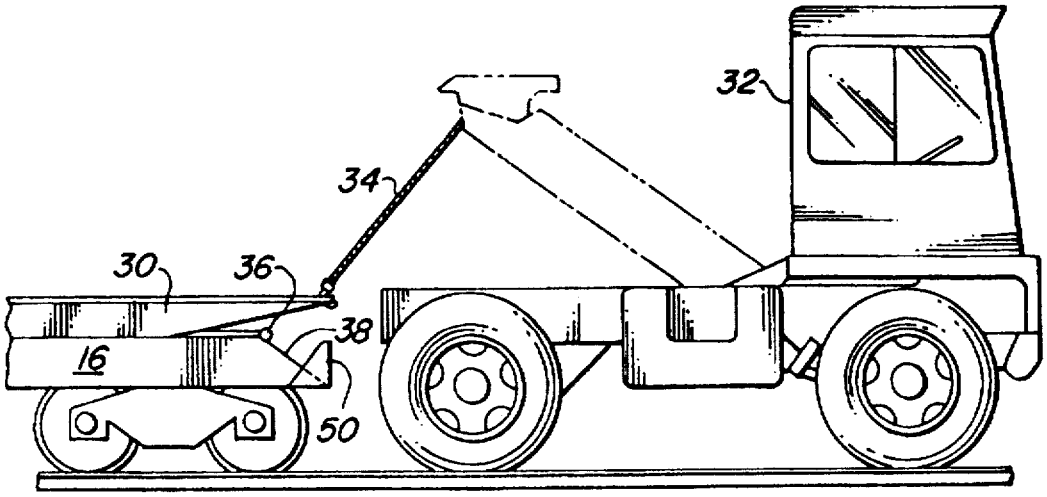
FIGS. 3A–3D illustrate the process for moving a ramp between a transport position and the position of FIG. 2.
Figure 3B:
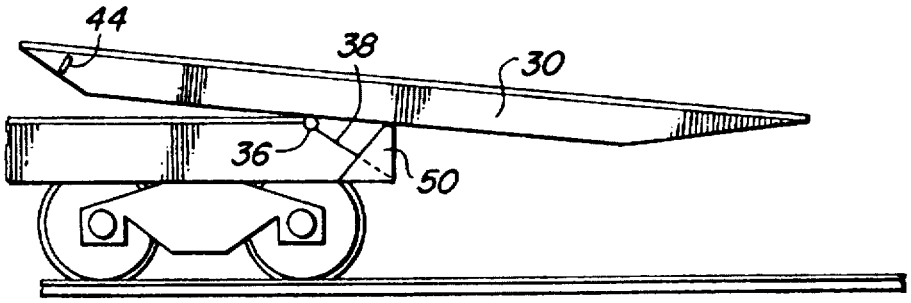
Figure 3C:
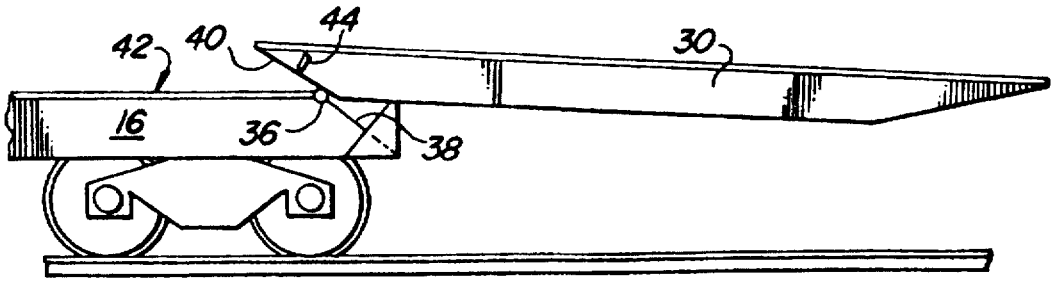
Figure 3D:
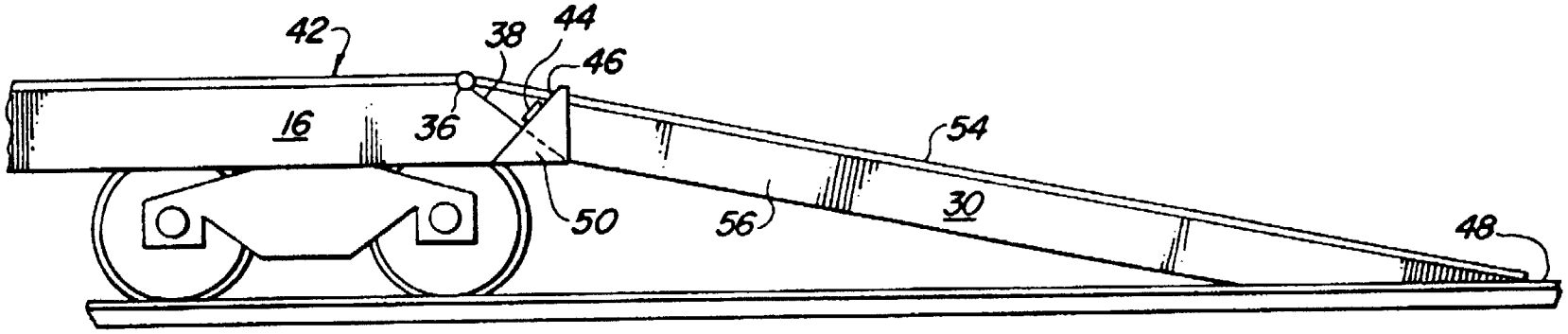

FIGS. 3A through 3D show the process of loading or unloading ramp 30 onto one of rail cars 16. FIG. 3A illustrates a yard tractor or hostler 32 positioned adjacent an end of one of rail cars 16, with a cable and hook assembly connected to an end of ramp 30. As tractor 32 is driven forward, ramp 30 is dragged in the same direction along the top of rail car 16. A roller 36 situated near the end of the rail car facilitates movement of ramp 30 along the top of the rail car. The roller is located at a breakpoint between the top of the rail car surface and a slanted surface 38 demarcating a cutaway region at the end of the rail car. A plate 50 is affixed, as by welding, to the side of the rail car and provides a sloped surface 46 against which a flange 44 near the end of ramp 30 rests. FIG. 3B shows ramp 30 as it has been moved partially forward so that the lower section of the ramp is resting on roller 36. The hostler has been omitted from FIGS. 3B, 3C and 3D, but will be understood to be a device that is usable to push or pull ramp 30 onto the rail car surface. In FIG. 3C, the end of ramp 30 is shown to have a tapered surface 40 which slides on roller 36 and allows the ramp to slide down slanted surface 38 until flange 44 abuts plate 50 or, during a loading process, allows the ramp to be pushed backward up the roller onto surface 42 of rail car 16. In FIG. 3D, ramp 30 is shown in its final assembled position with regard to rail car 16, with flange 44 on the side of ramp 30 now engaged against slanted surface 46 of plate 50. In this position, ramp 30 provides a substantially continuous surface from ground level 48 up to the top surface 42 of rail car 16. If desired, clamps can be provided to clamp flange 44 to plate 50 so that flange 44 is retained against surface 46. However, if the weight of the ramp combined with the weight of any load being applied to the ramp is sufficient to assure that flange 44 does not move away from surface 46 of plate 50, flange 44 and surface 46 of plate 50 together form a locking mechanism for locking the ramp to the rail car.

Figure 4A:
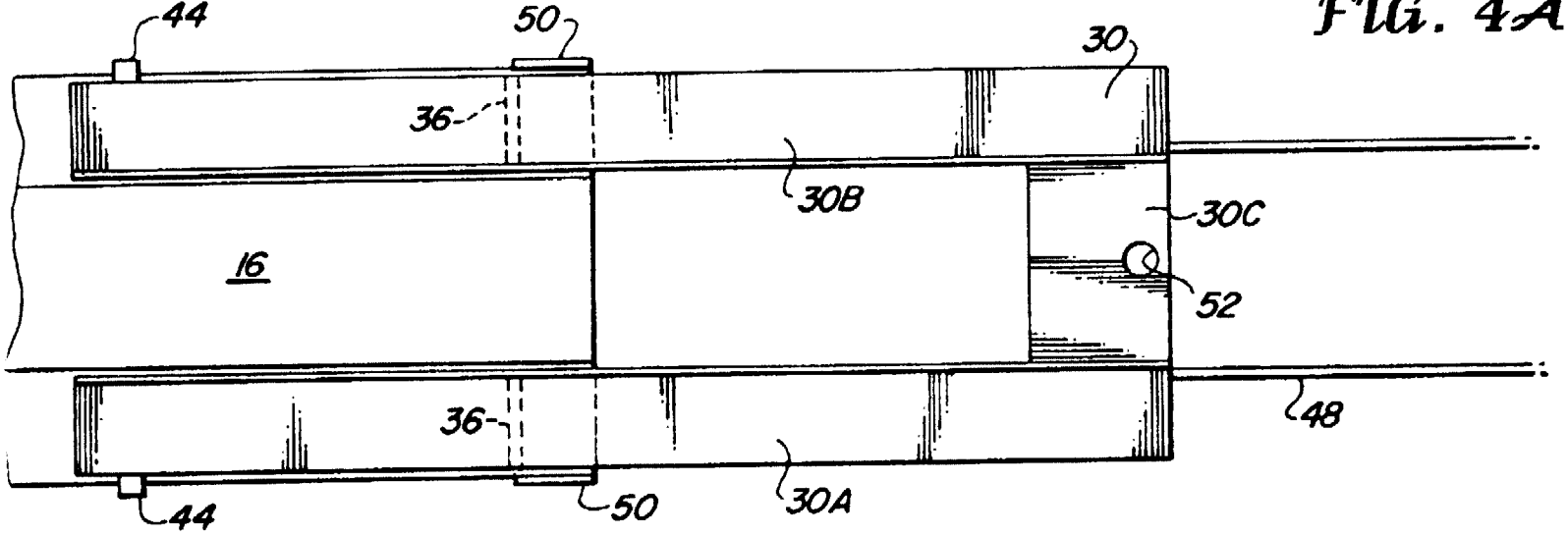
FIG. 4A is a plan view of one example of a ramp in an intermediate position corresponding to the elevation view of FIG. 3B.
Figure 4B:
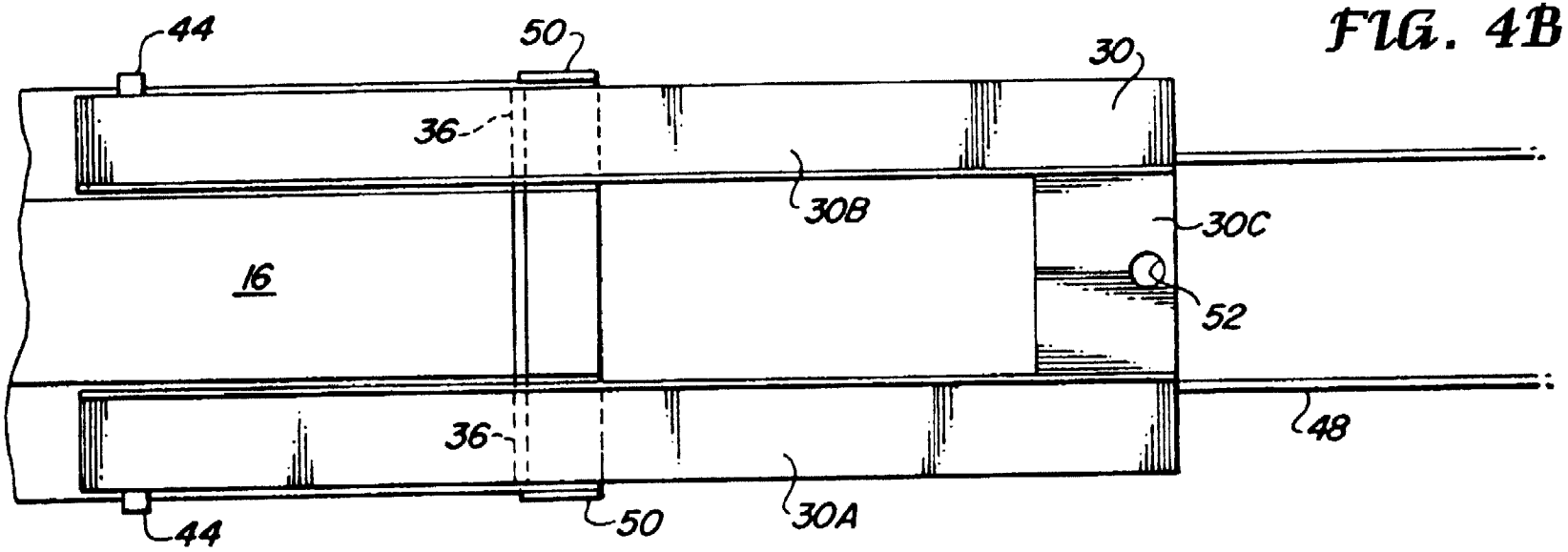
FIG. 4B is a plan view of another example of a ramp in an intermediate position corresponding to the elevation view of FIG. 3B.

In FIG. 4, which is a top view of ramp 30 partially seated on the top surface of rail car 16, flanges 44 are shown to extend outward of each side of ramp 30 and are designed to react against plates or end members 50 on each side of the rail car. Ramp 30 preferably comprises a pair of runways 30A and 30B joined together at a forward end by a cross member 30C. By splitting the ramp into the two runway sections, the ramp can be slid onto the top surface of the rail car with the stanchion 22 positioned between the runways. An aperture 52 provides a convenient means of connecting a hook and cable assembly 34 (shown in FIG. 3A) to ramp 30 to enable the ramp to be pulled forward from the top of the rail car. While ramp 30 is shown in FIG. 3D as being essentially a box structure having a top surface 54 supported on a pair of spaced side members 56, it will be appreciated that other forms of this structure could be utilized for ramps 30. For one, each of ramps 30 could be formed with a single I-beam support member 56. For another example, rollers 36, shown as a pair in FIG. 4A, could be joined as a single roller across the end of rail car 16, as shown in FIG. 4B.

While the invention has been described in what is presently considered to be a preferred embodiment, various modifications and improvements will become apparent to those skilled in the art. Accordingly, it is intended that the invention not be limited to the specific illustrated embodiment but be interpreted within the full spirit and scope of the appended claims.

What is claimed is:

1. A combination rail car and ramp assembly for circus loading of semi-trailers comprising a flatbed rail car having at least one loading end for accepting onloading of semi-trailers;

a ramp including a pair of parallel, spaced ramp members having a first end adapted to be supported on a ground level surface and a second end adapted to be releasably engaged with said loading end of said rail car;

a rigid cross-member extending between said parallel, spaced ramp members adjacent said one end thereof; and roller means on said rail car for engagement with said parallel, spaced ramp members, said parallel, spaced ramp members being shorter in length than said rail car so as to enable transport of said ramp members on said rail car bed;

said rail car including a sloped surface at said loading end;

said roller means comprising a roller extending across said rail car and positioned on said rail car adjacent an upper end of said sloped surface, said roller engaging an undersurface of said ramp members when said ramp members are being moved between said loading position and said transport position;

said slanted surface on each of opposite sides of said loading end of said car comprising a first plate affixed to one side of said car and a second plate affixed to the other side of said car.

2. A combination rail car and ramp assembly for circus loading of semi-trailers comprising:

a flat bed rail car having at least one loading end for accepting onloading of semi-trailers;

a ramp including a pair of parallel, spaced ramp members having a first end adapted to be supported on a ground level surface and a second end adapted to be releasably engaged with said loading end of said rail car;

a rigid cross-member extending between said parallel, spaced ramp members adjacent said one end thereof; and roller means on said rail car for engagement with said parallel, spaced ramp members, said parallel, spaced ramp members being shorter in length than said rail car so as to enable transport of said ramp members on said rail car bed;

said rail car including a sloped surface at said loading end;

said roller means comprising first and second rollers positioned on either side, respectively, of said rail car, each of said rollers being situated adjacent an upper end of said sloped surface and engaging an undersurface of a respective one of said ramp members when said ramp members are being moved between said loading position and said transport position;

said slanted surface on each of opposite sides of said loading end of said car comprising a first plate affixed to one side of said car and a second plate affixed to the other side of said car.

* * * * *